US011631526B2

(12) United States Patent
Tominaga et al.

(10) Patent No.: US 11,631,526 B2
(45) Date of Patent: Apr. 18, 2023

(54) INDUCTOR COMPONENT

(71) Applicant: Murata Manufacturing Co., Ltd., Kyoto-fu (JP)

(72) Inventors: Ryuichiro Tominaga, Nagaokakyo (JP); Yoshimasa Yoshioka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 369 days.

(21) Appl. No.: 16/930,142

(22) Filed: Jul. 15, 2020

(65) Prior Publication Data

US 2021/0074467 A1 Mar. 11, 2021

(30) Foreign Application Priority Data

Sep. 6, 2019 (JP) ..... JP2019-163151

(51) Int. Cl.
*H01F 27/28* (2006.01)
*H01F 17/00* (2006.01)
*H01F 27/32* (2006.01)

(52) U.S. Cl.
CPC ..... *H01F 27/2823* (2013.01); *H01F 17/0013* (2013.01); *H01F 27/32* (2013.01); *H01F 2017/0066* (2013.01)

(58) Field of Classification Search
CPC .. H01F 27/2823; H01F 17/0013; H01F 26/32; H01F 2017/0066; H01F 27/32
See application file for complete search history.

(56) References Cited

U.S. PATENT DOCUMENTS 6,903,645 B2 * 6/2005 Mizoguchi ..... H01F 27/292 336/200
2005/0184848 A1 * 8/2005 Yoshida ..... H01F 41/046 336/223
2014/0009254 A1 * 1/2014 Ohkubo ..... H01F 17/0033 336/192
2014/0292468 A1 * 10/2014 Motomiya ..... H01F 41/125 336/200
2015/0334842 A1 * 11/2015 Shimabe ..... H01L 23/49822 174/258

(Continued)

FOREIGN PATENT DOCUMENTS

CN 110136921 A 8/2019
JP 2013-236046 A 11/2013

(Continued)

*Primary Examiner* — Mang Tin Bik Lian
*Assistant Examiner* — Malcolm Barnes
(74) *Attorney, Agent, or Firm* — Studebaker & Brackett PC

(57) ABSTRACT

An inductor component that includes an element body; a coil wiring line that is arranged parallel to a first main surface of the element body inside the element body; and a first vertical wiring line and a second vertical wiring line that are buried inside the element body so that end surfaces thereof are exposed from the first main surface of the element body and that are electrically connected to the coil wiring line. In a first cross section that is perpendicular to a direction in which the coil wiring line extends and intersects the first vertical wiring line, a top surface of the coil wiring line contacts a bottom surface of the first vertical wiring line and the top surface of the coil wiring line is substantially shaped like a convex surface.

18 Claims, 4 Drawing Sheets

(56) References Cited

U.S. PATENT DOCUMENTS

| | | | | |
|---|---|---|---|---|
| 2017/0006704 | A1* | 1/2017 | Yoshioka | H01F 5/003 |
| 2017/0345551 | A1* | 11/2017 | Yoshioka | H01F 17/04 |
| 2018/0218830 | A1* | 8/2018 | Nakanishi | H01F 41/046 |
| 2019/0057803 | A1 | 2/2019 | Muraoka et al. | |
| 2019/0206611 | A1* | 7/2019 | Matsumoto | H01F 17/04 |
| 2019/0244743 | A1 | 8/2019 | Hirai et al. | |
| 2019/0362873 | A1* | 11/2019 | Arai | H01F 27/24 |
| 2020/0051728 | A1* | 2/2020 | Matsumoto | H01F 17/04 |

FOREIGN PATENT DOCUMENTS

| | | | | |
|---|---|---|---|---|
| JP | 2014-032978 | A | 2/2014 | |
| JP | 2018-125414 | A | 8/2018 | |
| JP | 2018-160491 | A | 10/2018 | |
| JP | 2019-046993 | A | 3/2019 | |
| WO | 2017/199746 | A1 | 11/2017 | |
| WO | WO-2017199746 | A1 * | 11/2017 | H01F 17/0013 |

* cited by examiner

INDUCTOR COMPONENT

CROSS-REFERENCE TO RELATED APPLICATION

This application claims benefit of priority to Japanese Patent Application No. 2019-163151, filed Sep. 6, 2019, the entire content of which is incorporated herein by reference.

BACKGROUND

Technical Field

The present disclosure relates to an inductor component.

Background Art

Japanese Unexamined Patent Application Publication No. 2014-32978 discloses an inductor component of the related art. The inductor component includes an element body, a coil wiring line that is arranged inside the element body, and a via conductor that is buried inside the element body and is electrically connected to the coil wiring line.

In this inductor component of the related art, there is a risk that when heat is externally applied such as during a mounting reflow process, stress generated during thermal fluctuations will become concentrated at a part where the coil wiring line and the via conductor contact each other and the reliability of the connection between the coil wiring line and the via conductor will decrease.

SUMMARY

Accordingly, the present disclosure provides an inductor component that can improve the reliability of a connection between a coil wiring line and a vertical wiring line.

An inductor component according to a preferred embodiment of the present disclosure includes an element body; a coil wiring line that is arranged parallel to a first main surface of the element body inside the element body; and a first vertical wiring line and a second vertical wiring line that are buried inside the element body so that end surfaces thereof are exposed from the first main surface of the element body and that are electrically connected to the coil wiring line.

In a first cross section that is perpendicular to a direction in which the coil wiring line extends and intersects the first vertical wiring line, a top surface of the coil wiring line contacts a bottom surface of the first vertical wiring line and the top surface of the coil wiring line is substantially shaped like a convex surface.

Here, the top surface of the coil wiring line refers to the surface of the coil wiring line that is nearer the first main surface of the element body.

In this case, since the top surface of the coil wiring line is substantially shaped like a convex surface in the first cross section, the area of contact between the top surface of the coil wiring line and the bottom surface of the first vertical wiring line can be increased and the reliability of the connection between the coil wiring line and the first vertical wiring line can be improved.

In addition, since the top surface of the coil wiring line is substantially shaped like a convex surface in the first cross section, the angle formed between the top surface of the coil wiring line and a side surface of the first vertical wiring line can be made large and stress concentrated at an intersection between the top surface of the coil wiring line and the side surface of the first vertical wiring line can be alleviated.

In the inductor component, in the first cross section, a curvature of the top surface of the coil wiring line preferably substantially lies in a range from $1/8000$ m to $1/6000$ m.

In this case, since the curvature of the top surface of the coil wiring line is greater than or equal to $1/8000$ m, stress concentrated at the intersection between the top surface of the coil wiring line and the side surface of the first vertical wiring line can be reliably alleviated. Furthermore, since the curvature of the top surface of the coil wiring line is less than or equal to $1/6000$ m, the first vertical wiring line can be reliably formed on the top surface of the coil wiring line.

In the inductor component, in the first cross section, the top surface of the coil wiring line preferably intersects a side surface of the first vertical wiring line, and an angle formed between a tangent, which is tangential to the top surface of the coil wiring line at an intersection between the top surface of the coil wiring line and the side surface of the first vertical wiring line, and the side surface of the first vertical wiring line preferably substantially lies in a range from 65° to 77°.

In this case, since the angle formed between the top surface of the coil wiring line and the side surface of the first vertical wiring line is greater than or equal to 65°, stress concentrated at the intersection between the top surface of the coil wiring line and the side surface of the first vertical wiring line can be reliably alleviated. Furthermore, since the angle formed between the top surface of the coil wiring line and the side surface of the first vertical wiring line is less than or equal to 77°, the first vertical wiring line can be reliably formed on the top surface of the coil wiring line.

In the inductor component, the element body preferably includes a resin layer that covers the coil wiring line, and the first vertical wiring line and the second vertical wiring line preferably each include a via conductor that penetrates through the resin layer and contacts the top surface of the coil wiring line.

In this case, the via conductor is subjected to additional stress arising from the different thermal expansion coefficients of the via conductor and the resin layer as a result of the via conductor penetrating through the resin layer, but the reliability of the connection between the coil wiring line and the via conductor can be improved even in this state.

In the inductor component, a bottom surface of the via conductor is preferably shorter than the top surface of the via conductor in terms of length in a direction parallel to the first main surface in the first cross section.

In this case, although the area of the bottom surface of the via conductor is relatively small, the reliability of the connection between the coil wiring line and the via conductor can be improved even in this state.

In the inductor component, in a second cross section that is perpendicular to a direction in which the coil wiring line extends and intersects the second vertical wiring line, a top surface of the coil wiring line preferably contacts a bottom surface of the second vertical wiring line and the top surface of the coil wiring line is preferably substantially shaped like a convex surface.

In this case, since the top surface of the coil wiring line is substantially shaped like a convex surface in the second cross section as well, the area of contact between the top surface of the coil wiring line and the bottom surface of the second vertical wiring line can be increased and the reliability of the connection between the coil wiring line and the second vertical wiring line can be improved.

In addition, since the top surface of the coil wiring line is substantially shaped like a convex surface in the second cross section as well, the angle formed between the top surface of the coil wiring line and a side surface of the second vertical wiring line can be made large and stress concentrated at an intersection between the top surface of the coil wiring line and the side surface of the second vertical wiring line can be alleviated.

According to the inductor component of the preferred embodiment of the present disclosure, the reliability of a connection between a coil wiring line and a vertical wiring line can be improved.

Other features, elements, characteristics and advantages of the present disclosure will become more apparent from the following detailed description of preferred embodiments of the present disclosure with reference to the attached drawings.

DETAILED DESCRIPTION

Hereafter, inductor components according to aspects of the present disclosure will be described in detail using the illustrated embodiments. Note that the drawings may contain schematic parts and may not reflect the actual dimensions and proportions.

First Embodiment

Configuration

Figure 1A:
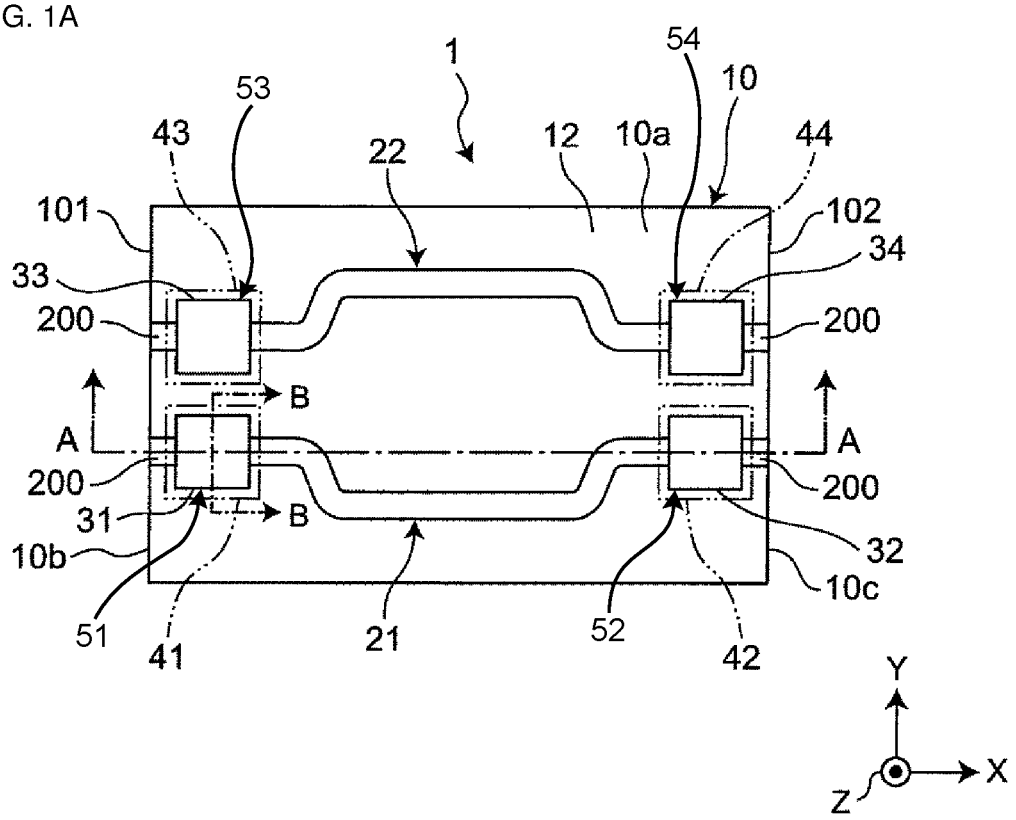
FIG. 1A is a see-through plan view illustrating an inductor component according to a first embodiment.
Figure 1B:
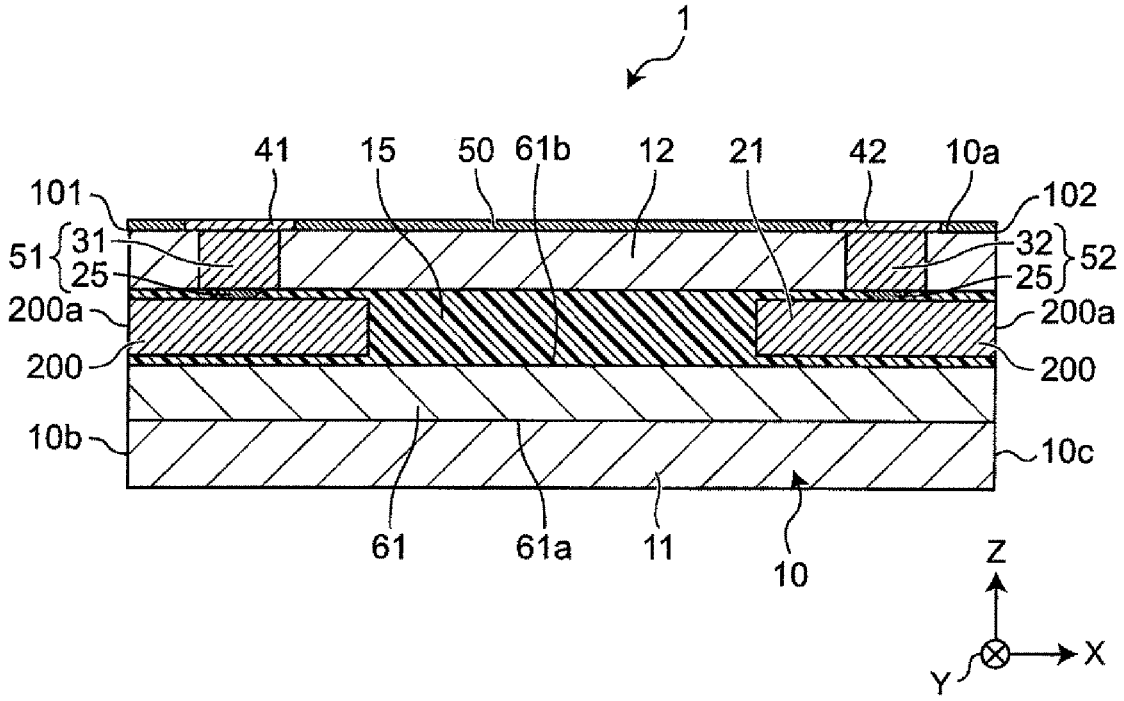
FIG. 1B is a sectional view taken along line A-A in FIG. 1A.

FIG. 1A is a see-through plan view illustrating an inductor component according to a first embodiment. FIG. 1B is a sectional view taken along line A-A in FIG. 1A. An inductor component 1 is for example a component that is mounted in an electronic appliance such as a personal computer, a DVD player, a digital camera, a TV, a mobile phone, or an in-car electronic appliance and has a substantially rectangular parallelepiped shape on the whole. However, the shape of the inductor component 1 is not particularly limited and the inductor component 1 may instead substantially have a cylindrical or polygonal columnar shape, a truncated cone shape, or a polygonal truncated pyramidal shape.

As illustrated in FIGS. 1A and 1B, the inductor component 1 includes an element body 10, a first coil wiring line 21 and a second coil wiring line 22 that are arranged inside the element body 10, a first vertical wiring line 51, a second vertical wiring line 52, a third vertical wiring line 53, and a fourth vertical wiring line 54 that are buried inside the element body 10 so that end surfaces thereof are exposed from a first main surface 10*a* of the element body 10, a first outer terminal 41, a second outer terminal 42, a third outer terminal 43, and a fourth outer terminal 44 that are provided on the first main surface 10*a* of the element body 10, and an insulating film 50 that is provided on the first main surface 10*a* of the element body 10. In the figures, the thickness direction of the inductor component 1 is illustrated as a Z direction with the positive Z direction being the direction toward the upper side and the negative Z direction being the direction toward the lower side. In a plane of the inductor component 1 perpendicular to the Z direction, the length direction of the inductor component 1 is illustrated as an X direction and the width direction of the inductor component 1 is illustrated as a Y direction.

The element body 10 includes an insulating layer 61, a first magnetic layer 11 that is arranged on a lower surface 61*a* of the insulating layer 61, a resin layer 15 that is arranged on an upper surface 61*b* of the insulating layer 61 and covers the first coil wiring line 21 and the second coil wiring line 22, and a second magnetic layer 12 that is arranged on an upper surface of the resin layer 15. The first main surface 10*a* of the element body 10 corresponds to the upper surface of the second magnetic layer 12. The element body 10 has a four-layer structure consisting of the insulating layer 61, the resin layer 15, the first magnetic layer 11, and the second magnetic layer 12, but the number of layers forming the element body 10 is not particularly limited and may be a number of layers other than four layers, and the element body 10 may have a single-layer structure consisting of only a magnetic layer or only an insulating layer or may have a multilayer structure.

The insulating layer 61 has a substantially layer-like shape with the main surfaces thereof having substantially rectangular shapes, and the thickness of the insulating layer 61 substantially lies in a range from 10 μm to 100 μm, for example. The insulating layer 61 is for example preferably an insulating resin layer such as an epoxy resin or polyimide resin layer that does not contain a base material such as glass cloth from the viewpoint of realizing a low profile, but the insulating layer 61 may instead be for example a sintered body such as a magnetic layer such as a NiZn or MnZn ferrite layer or a non-magnetic layer such as an alumina or glass layer, or may be a resin layer including a base material such as glass epoxy. Furthermore, when the insulating layer 61 is a sintered body, it is possible to ensure that the insulating layer 61 is strong and flat and the workability of a material stacked on the insulating layer 61 is improved. In addition, when the insulating layer 61 is a sintered body, it is preferable that the insulating layer 61 be subjected to a grinding process from the viewpoint of realizing a low profile, and it is particularly preferable that the insulating layer 61 be ground down from the lower side on which nothing is stacked.

The first magnetic layer 11 and the second magnetic layer 12 are magnetic resin layers composed of a resin containing a metal magnetic powder. The resin is for example an organic insulating material consisting of an epoxy resin, bismaleimide, a liquid crystal polymer, polyimide, or the like. The average particle diameter of the metal magnetic powder substantially lies in a range from 0.1 μm to 5 μm, for example. When manufacturing the inductor component 1, the average particle size of the metal magnetic powder can be calculated as a particle size equivalent to an integrated value of 50% in a particle size distribution obtained by laser diffraction and scattering. The metal magnetic powder is for example a FeSi alloy such as FeSiCr, a FeCo alloy, a Fe alloy such as NiFe, or an amorphous alloy thereof. The content of the metal magnetic powder preferably substantially lies in a range from 20 to 70 Vol % of the entire magnetic layer. In the case where the average particle diameter of the metal magnetic powder is less than or equal to 5 μm, the direct current superposition characteristic is improved and iron loss at radio frequencies can be reduced by the fine powder. Note that a ferrite magnetic powder such as a NiZn ferrite powder or a MnZn ferrite powder may be used instead of a metal magnetic powder.

The resin layer 15 covers the first coil wiring line 21 and the second coil wiring line 22. The resin layer 15 ensures that the adjacent first and second coil wiring lines 21 and 22 are insulated from each other. More specifically, the resin layer 15 covers the entirety of the bottom surfaces and side surfaces of the first and second coil wiring lines 21 and 22 and covers the top surfaces of the first and second coil wiring lines 21 and 22 except for the parts of the top surfaces of the first and second coil wiring lines 21 and 22 that are connected to via conductors 25. The resin layer 15 is composed of an insulating material that does not contain a magnetic material and for example is composed of a resin material such as an epoxy resin, a phenol resin, or a polyimide resin. Furthermore, the resin layer 15 may include a non-magnetic filler such as silica, and in this case, the strength, workability, and electrical characteristics of the resin layer 15 can be improved. In addition, the resin layer 15 may include a hole at a position corresponding to the inner diameter parts of the first and second coil wiring lines 21 and 22, and in this case, a magnetic layer may be provided in the hole.

The first coil wiring line 21 and the second coil wiring line 22 are arranged so as to be parallel to the first main surface 10*a* of the element body 10. In this way, the first coil wiring line 21 and the second coil wiring line 22 can be formed in a direction parallel to the first main surface 10*a* and a low profile can be realized for the inductor component 1. The first coil wiring line 21 and the second coil wiring line 22 are arranged on the same plane inside the element body 10. More specifically, the first coil wiring line 21 and the second coil wiring line 22 are only formed on the upper side of the insulating layer 61 and are covered by the resin layer 15.

The first and second coil wiring lines 21 and 22 are wound in substantially planar shapes. More specifically, the first and second coil wiring lines 21 and 22 have substantially semi-elliptical arc-like shapes when viewed in the Z direction. In other words, the first and second coil wiring lines 21 and 22 are curved wiring lines that are each wound through approximately half a turn. In addition, the first and second coil wiring lines 21 and 22 each include a straight portion in the middle thereof.

The thicknesses of the first and second coil wiring lines 21 and 22 preferably substantially lie in a range from 40 μm to 120 μm, for example. As an example of the first and second coil wiring lines 21 and 22, the first and second coil wiring lines 21 and 22 may have a thickness of 45 μm, a wiring line width of 40 μm, and an inter-wiring-line spacing of 10 μm. The inter-wiring-line spacing preferably substantially lies in a range from 3 μm to 20 μm.

The first and second coil wiring lines 21 and 22 are composed of a conductive material, and for example are composed of a metal material having a low electrical resistance such as Cu, Ag, or Au. In this embodiment, the inductor component 1 only includes one layer of the first and second coil wiring lines 21 and 22 and a low profile can be realized for the inductor component 1.

A first end and a second end of the first coil wiring line 21 are respectively electrically connected to the first vertical wiring line 51 and the second vertical wiring line 52, which are positioned toward the outside. The first coil wiring line 21 has a substantially curved shape that draws an arc from the first vertical wiring line 51 and the second vertical wiring line 52 toward the center of the inductor component 1. In other words, the first coil wiring line 21 has pad portions at both ends thereof, the pad portions having a larger line width than the spiral-shaped portion of the first coil wiring line 21. The first coil wiring line 21 is directly connected to the first and second vertical wiring lines 51 and 52 at these pad portions.

Similarly, a first end and a second end of the second coil wiring line 22 are respectively electrically connected to the third vertical wiring line 53 and the fourth vertical wiring line 54, which are positioned toward the outside. The second coil wiring line 22 has a substantially curved shape that draws an arc from the third vertical wiring line 53 and the fourth vertical wiring line 54 toward the center of the inductor component 1.

In this case, in each of the first and second coil wiring lines 21 and 22, the area enclosed by the curve drawn by the first or second coil wiring line 21 or 22 and a straight line connecting the two ends of the first or second coil wiring line 21 or 22 is referred to as the inner diameter part. Here, the inner diameter parts of the first and second coil wiring lines 21 and 22 do not overlap when looking in the Z direction. On the other hand, the first and second coil wiring lines 21 and 22 are separated from each other at their respective arc-shaped portions.

The wiring lines further extend from the positions where first and second coil wiring lines 21 and 22 are connected to the first to fourth vertical wiring lines 51 to 54 toward the outside of the chip and these wiring lines are exposed outside the chip. In other words, the first and second coil wiring lines 21 and 22 have exposed portions 200 that are exposed to the outside from the side surfaces of the inductor component 1 which are parallel to the stacking direction of layers of the inductor component 1.

These wiring lines are wiring lines that are connected to power supply wiring lines when additional electrolytic plating is performed after forming the shapes of the first and second coil wiring lines 21 and 22 in the process of manufacturing the inductor component 1. These power supply wiring lines allow the additional electrolytic plating to be easily performed on the inductor substrate at a stage before the individual inductor components 1 are separated from each other and enable the distance between the wiring lines to be reduced. In addition, the magnetic coupling between the first and second coil wiring lines 21 and 22 can be increased by decreasing the distance between the wiring lines of the first and second coil wiring lines 21 and 22 by performing the additional electrolytic plating.

Furthermore, since the first and second coil wiring lines 21 and 22 have the exposed portions 200, it is possible to ensure resistance to electrostatic breakdown while the inductor substrate is being processed. The thicknesses of exposed surfaces 200*a* of the exposed portions 200 of the coil wiring lines 21 and 22 preferably substantially lie in a range from 45 μm up to the thicknesses of the coil wiring lines 21 and 22. With this configuration, the thicknesses of the exposed surfaces 200*a* are less than or equal to the thicknesses of the coil wiring lines 21 and 22 and as a result the relative proportions of the magnetic layers 11 and 12 can be increased and the inductance can be improved. Furthermore, the thicknesses of the exposed surfaces 200*a* are greater than or equal to 45 μm and as a result the occurrence of disconnections can be reduced. The exposed surfaces 200*a* are preferably composed of oxide films. Thus, the occurrence of short circuits between the inductor component 1 and adjacent components can be suppressed.

The first to fourth vertical wiring lines 51 to 54 extend in the Z direction from the coil wiring lines 21 and 22 and penetrate through the inside of the element body 10. The first to fourth vertical wiring lines 51 to 54 are composed of an electrically conductive material and for example are composed of the same material as the coil wiring lines 21 and 22.

The first vertical wiring line 51 includes a via conductor 25 that extends upward from the upper surface of one end of the first coil wiring line 21 and penetrates through the inside of the resin layer 15 and a first columnar wiring line 31 that extends upward from the via conductor 25 and penetrates through the inside of the second magnetic layer 12. The second vertical wiring line 52 includes a via conductor 25 that extends upward from the upper surface of the other end of the first coil wiring line 21 and penetrates through the inside of the resin layer 15 and a second columnar wiring line 32 that extends upward from the via conductor 25 and penetrates through the inside of the second magnetic layer 12.

The third vertical wiring line 53 includes a via conductor 25 that extends upward from the upper surface of one end of the second coil wiring line 22 and penetrates through the inside of the resin layer 15 and a third columnar wiring line 33 that extends upward from the via conductor 25 and penetrates through the inside of the second magnetic layer 12. The fourth vertical wiring line 54 includes a via conductor 25 that extends upward from the upper surface of the other end of the second coil wiring line 22 and penetrates through the inside of the resin layer 15 and a fourth columnar wiring line 34 that extends upward from the via conductor 25 and penetrates through the inside of the second magnetic layer 12. The first columnar wiring line 31 is located closer to the third columnar wiring line 33 than to the fourth columnar wiring line 34.

Therefore, the first vertical wiring line 51, the second vertical wiring line 52, the third vertical wiring line 53, and the fourth vertical wiring line 54 extend in straight lines from the first coil wiring line 21 and the second coil wiring line 22 to the end surfaces thereof that are exposed from the first main surface 10*a* in a direction perpendicular to the end surfaces. This enables the first outer terminal 41, the second outer terminal 42, the third outer terminal 43, and the fourth outer terminal 44 and the first coil wiring line 21 and the second coil wiring line 22 to be connected to each other across shorter distances and as a result a lower resistance and a higher inductance can be realized for the inductor component 1.

The first to fourth outer terminals 41 to 44 are provided on the first main surface 10*a* of the element body 10 (upper surface of second magnetic layer 12). The first to fourth outer terminals 41 to 44 are composed of electrically conductive materials and for example have a three-layer structure consisting of Cu which has low electrical resistance and excellent stress resistance, Ni which has excellent corrosion resistance, and Au which has excellent solder wettability and reliability stacked in this order in a direction toward the outside.

The first outer terminal 41 contacts the end surface of the first columnar wiring line 31 that is exposed from the first main surface 10*a* of the element body 10, and is electrically connected to the first columnar wiring line 31. Thus, the first outer terminal 41 is electrically connected to one end of the first coil wiring line 21. The second outer terminal 42 contacts the end surface of the second columnar wiring line 32 that is exposed from the first main surface 10*a* of the element body 10, and is electrically connected to the second columnar wiring line 32. Thus, the second outer terminal 42 is electrically connected to the other end of the first coil wiring line 21.

Similarly, the third outer terminal 43 contacts an end surface of the third columnar wiring line 33, is electrically connected to the third columnar wiring line 33, and is thus electrically connected to one end of the second coil wiring line 22. The fourth outer terminal 44 contacts an end surface of the fourth columnar wiring line 34, is electrically connected to the fourth columnar wiring line 34, and is thus electrically connected to the other end of the second coil wiring line 22. The first outer terminal 41 is located closer to the third outer terminal 43 than to the fourth outer terminal 44.

In the inductor component 1, the first main surface 10*a* has a first end edge 101 and a second end edge 102 that extend in straight lines corresponding to sides of a rectangular shape. The first end edge 101 and the second end edge 102 are the end edges of the first main surface 10*a* that adjoin a first side surface 10*b* and a second side surface 10*c* of the element body 10. The first outer terminal 41 and the third outer terminal 43 are arranged along the first end edge 101 which is on the side of the element body 10 near the first side surface 10*b* and the second outer terminal 42 and the fourth outer terminal 44 are arranged along the second end edge 102 which is on the side of the element body 10 near the second side surface 10*c*. Note that the first side surface 10*b* and the second side surface 10*c* of the element body 10 are surfaces of the element body 10 that extend along the Y direction and coincide with the first end edge 101 and the second end edge 102 when looking in a direction perpendicular to the first main surface 10*a* of the element body 10. The direction in which the first outer terminal 41 and the third outer terminal 43 are arranged is a direction that connects the center of the first outer terminal 41 and the center of the third outer terminal 43 and the direction in which the second outer terminal 42 and the fourth outer terminal 44 are arranged is a direction that connects the center of the second outer terminal 42 and the center of the fourth outer terminal 44.

The insulating film 50 is provided on the parts of the first main surface 10*a* of the element body 10 where the first to fourth outer terminals 41 to 44 are not provided. However, the insulating film 50 may overlap the first to fourth outer terminals 41 to 44 with the edges of the first to fourth outer terminals 41 to 44 being raised on top of the insulating film 50. The insulating film 50 is for example composed of a resin material having a high electrical insulating property such as an acrylic resin, an epoxy resin, or polyimide. Thus, the degree of insulation between the first to fourth outer terminals 41 to 44 can be improved. Furthermore, the insulating film 50 takes the place of a mask used when forming the patterns of the first to fourth outer terminals 41 to 44 and manufacturing efficiency is improved. In addition, when the metal magnetic powder is exposed from the resin, the insulating film 50 can prevent the metal magnetic powder from being exposed to the outside by covering the exposed metal magnetic powder. Note that the insulating film 50 may contain a filler composed of an insulating material.

Figure 2:
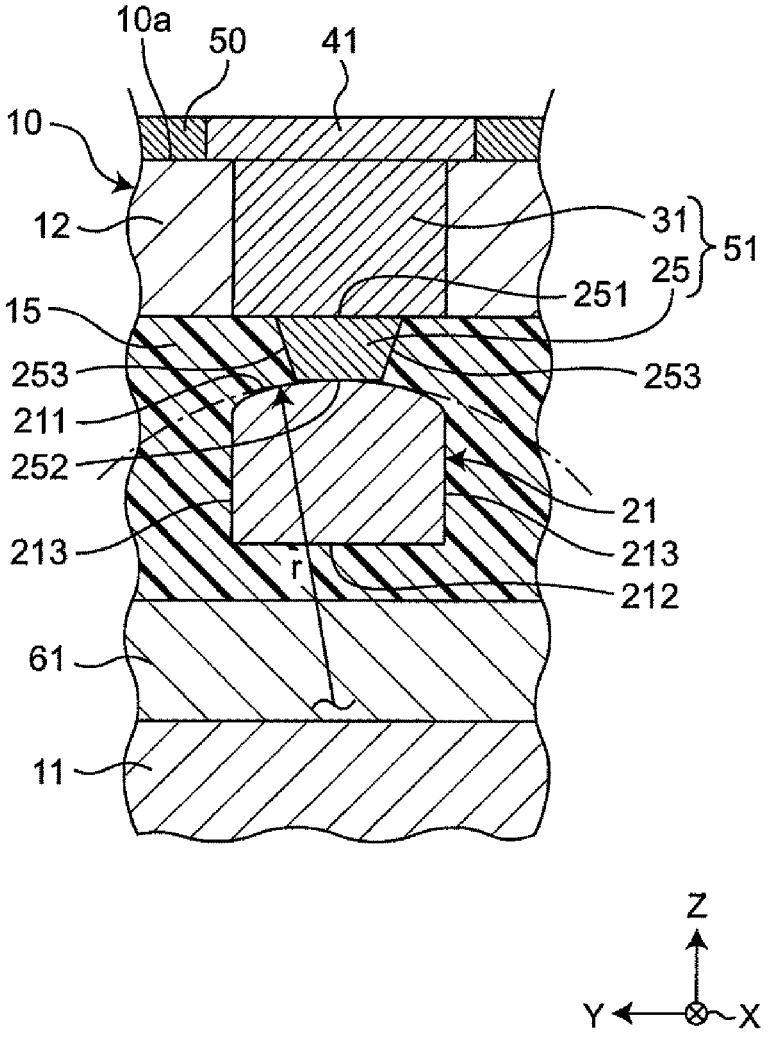
FIG. 2 is a sectional view taken along line B-B in FIG. 1A.

FIG. 2 is a sectional view taken along line B-B in FIG. 1A. As illustrated in FIG. 2, in a first cross section that is perpendicular to the direction in which the first coil wiring line 21 extends and intersects the first vertical wiring line 51, the first coil wiring line 21 has a top surface 211, a bottom surface 212 that faces the top surface 211, and left and right side surfaces 213 that are interposed between the top surface 211 and the bottom surface 212. The via conductor 25 has a top surface 251, a bottom surface 252 that faces the top surface 251, and left and right side surfaces 253 that are interposed between the top surface 251 and the bottom surface 252. The top surfaces 211 and 251 refer to the surfaces that are nearer the first main surface 10*a* of the element body 10. The first cross section passes through the center of the first vertical wiring line 51 when looking in the Z direction, for example.

In the first cross section, the top surface 211 of the first coil wiring line 21 contacts the bottom surface of the first vertical wiring line 51 (bottom surface 252 of via conductor 25) and the top surface 211 of the first coil wiring line 21 is shaped like a convex curved surface that is convex toward the first main surface 10*a*.

With this configuration, in the first cross section, the top surface 211 of the first coil wiring line 21 is substantially shaped like a convex surface, and therefore the area of contact between the top surface 211 of the first coil wiring line 21 and the bottom surface of the first vertical wiring line 51 (bottom surface 252 of via conductor 25) can be increased and the reliability of the connection between the first coil wiring line 21 and the first vertical wiring line 51 (via conductor 25) can be improved. In contrast, in the inductor component of the related art, the top surface of the first coil wiring line is flat and therefore the area of contact between the top surface of the first coil wiring line and the bottom surface of the via conductor is reduced and the reliability of the connection between the first coil wiring line and the via conductor is reduced.

Furthermore, in the first cross section, since the top surface 211 of the first coil wiring line 21 is a substantially shaped like a convex surface, the angle formed between the top surface 211 of the first coil wiring line 21 and a side surface of the first vertical wiring line 51 (side surface 253 of via conductor 25) can be increased and stress concentrated at the intersection between the top surface 211 of the first coil wiring line 21 and the side surface of the first vertical wiring line 51 (side surface 253 of via conductor 25) can be alleviated. In contrast, in the inductor component of the related art, the top surface of the first coil wiring line is flat, and therefore the angle formed between the top surface of the first coil wiring line and a side surface of the via conductor is small and stress is concentrated at the intersection between the top surface of the first coil wiring line and the side surface of the via conductor.

Furthermore, the via conductor 25 is subjected to additional stress arising from the different thermal expansion coefficients of the via conductor 25 and the resin layer 15 as a result of each via conductor 25 penetrating through the resin layer 15, but the reliability of the connection between the first coil wiring line 21 and the via conductor 25 can be improved even in this state.

It is preferable that the area of the bottom surface 252 of the via conductor 25 be smaller than the area of the top surface 251 of the via conductor 25. In other words, in the first cross section, the width of the via conductor 25 between the two side surfaces 253 of the via conductor 25 decreases in the direction from the top surface 251 toward the bottom surface 252, and the bottom surface 252 of the via conductor 25 is shorter than the top surface 251 of the via conductor 25 in terms of length in a direction parallel to the first main surface 10*a* in the first cross section (length along Y direction in FIG. 2). With this configuration, although the area of the bottom surface 252 of the via conductor 25 is reduced, the reliability of the connection between the first coil wiring line 21 and the via conductor 25 can be improved even in this state.

It is preferable that the curvature of the top surface 211 of the first coil wiring line 21 (1/radius of curvature r) substantially lie in a range from $1/8000$ m to $1/6000$ m in the first cross section. With this configuration, it could be confirmed that stress concentrated at the intersection between the top surface 211 of the first coil wiring line 21 and the side surface of the first vertical wiring line 51 (side surface 253 of via conductor 25) could be reliably alleviated due to the curvature of the top surface 211 of the first coil wiring line 21 being greater than or equal to $1/8000$ m. Furthermore, it could be confirmed that the first vertical wiring line 51 could be reliably formed on the top surface 211 of the first coil wiring line 21 due to the curvature of the top surface 211 of the first coil wiring line 21 being less than or equal to $1/6000$ m.

In a second cross section that is perpendicular to the direction in which the first coil wiring line 21 extends and intersects the second vertical wiring line 52, it is preferable that the top surface 211 of the first coil wiring line 21 contact the bottom surface of the second vertical wiring line 52 (bottom surface 252 of via conductor 25) and that the top surface 211 of the first coil wiring line 21 be substantially shaped like a convex surface. With this configuration, in the second cross section as well, the top surface 211 of the first coil wiring line 21 is substantially shaped like a convex surface, and therefore the area of contact between the top surface 211 of the first coil wiring line 21 and the bottom surface of the second vertical wiring line 52 (bottom surface 252 of via conductor 25) can be increased and the reliability of the connection between the first coil wiring line 21 and the second vertical wiring line 52 (via conductor 25) can be improved. Furthermore, in the second cross section as well, the top surface 211 of the first coil wiring line 21 is substantially shaped like a convex surface and therefore the angle formed between the top surface 211 of the first coil wiring line 21 and a side surface of the second vertical wiring line 52 (side surface 253 of via conductor 25) can be increased and stress concentrated at the intersection between the top surface 211 of the first coil wiring line 21 and the side surface of the second vertical wiring line 52 (side surface 253 of via conductor 25) can be alleviated.

Note that the same configuration as the first coil wiring line 21 is also preferable for the second coil wiring line 22 and description thereof is omitted here.

Manufacturing Method

Next, a method of manufacturing the inductor component 1 will be described.

First, part of the resin layer 15 is formed on the upper surface 61*b* of the insulating layer 61 and additionally a seed layer is formed on the resin layer 15 by performing sputtering, electroless plating, or the like. Next, a resist in which through holes have been formed at the places where the coil wiring lines 21 and 22 are to be located on the seed layer is arranged on the seed layer and the wiring lines are formed in the through holes of the resist by performing electrolytic plating. Formation of the coil wiring lines 21 and 22 is completed by removing the resist and the unwanted parts of the seed layer. At this time, the convex surfaces of the top surfaces 211 of the coil wiring lines 21 and 22 are formed by performing additional plating (extra plating) after removal of the resist. Note that the curvatures of the convex surfaces can be adjusted by for example varying the processing time used to form the extra plating or the convex surfaces can be molded to any desired curvature by using a resist or the like as necessary. Then, the remaining parts of the resin layer 15 are formed so as to cover the coil wiring lines 21 and 22. After that, via holes are provided in the resin layer 15 by forming openings using a laser and the via conductors 25 and columnar wiring lines 31 to 34 that extend upwards from the coil wiring lines 21 and 22 are formed. At this time, the inclinations of the two side surfaces 253 of each via conductor 25 with respect to the first main surface 10*a* can be adjusted by changing the degree of light convergence of the laser and therefore the relative relationship between the top surface 251 and the bottom surface 252 of each via conductor 25 can be adjusted. The via holes may be formed by etching or using a drill instead of using a laser.

After that, the second magnetic layer 12 is formed on the resin layer 15 so as to cover the resin layer 15 by pressure bonding a magnetic sheet composed of a magnetic material to the upper surface of the resin layer 15. The end surfaces of the columnar wiring lines 31 to 34 are exposed by subjecting the second magnetic layer 12 to grinding.

After that, the insulating film 50 is formed on the upper surface of the second magnetic layer 12. Through holes through which the end surfaces of the columnar wiring lines 31 to 34 and the second magnetic layer 12 are exposed are formed in regions of the insulating film 50 where the outer terminals will be formed.

After that, part of the insulating layer 61 is removed by performing grinding. At this time, the insulating layer 61 is not completely removed, and part of the insulating layer 61 is left intact. The first magnetic layer 11 is formed by pressure bonding a magnetic sheet composed of a magnetic material to the lower surface 61*a* on the ground down side of the insulating layer 61 and then grinding down the magnetic sheet to a suitable thickness.

After that, the outer terminals 41 to 44 are formed by forming metal films that grow from the columnar wiring lines 31 to 34 inside the through holes of the insulating film 50 by performing electroless plating.

Second Embodiment

Figure 3:
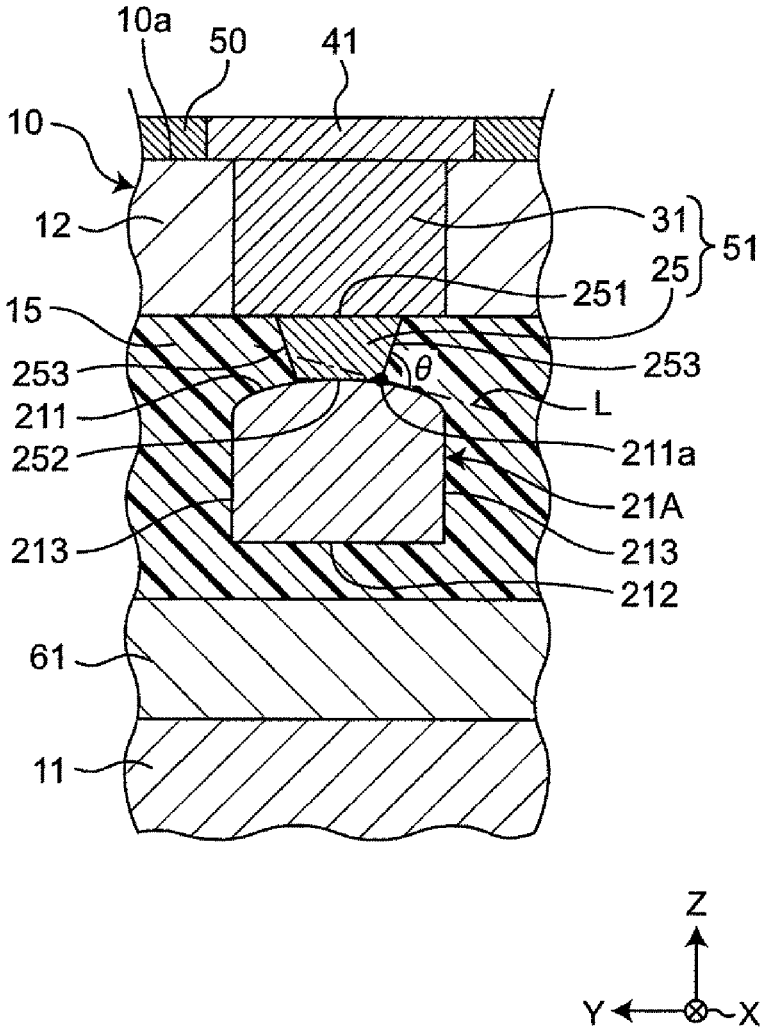
FIG. 3 is a sectional view illustrating an inductor component according to a second embodiment.

FIG. 3 is a sectional view illustrating an inductor component according to a second embodiment. The second embodiment differs from the first embodiment with respect to the shape of the coil wiring lines. This difference will be described below. The rest of the configuration is the same as in the first embodiment, and parts that are the same as in the first embodiment are denoted by the same symbols and description thereof is omitted.

As illustrated in FIG. 3, in the inductor component of the second embodiment, in the first cross section, a top surface 211 of a first coil wiring line 21A intersects a side surface of a first vertical wiring line 51 (side surface 253 of via conductor 25) and an angle θ formed between a tangent L, which is tangential to an intersection 211*a* between the top surface 211 of the first coil wiring line 21A and a side surface of the first vertical wiring line 51 (side surface 253 of via conductor 25), and the side surface of the first vertical wiring line 51 (side surface 253 of via conductor 25) substantially lies in a range from 65° to 77°.

With this configuration, it could be confirmed that stress concentrated at the intersection 211*a* between the top surface 211 of the first coil wiring line 21A and the side surface of the first vertical wiring line 51 could be reliably alleviated due to the angle θ between the top surface 211 of the first coil wiring line 21A and the side surface of the first vertical wiring line 51 being greater than or equal to 65°. Furthermore, it could be confirmed that the first vertical wiring line 51 could be reliably formed on the top surface 211 of the first coil wiring line 21A due to the angle θ between the top surface 211 of the first coil wiring line 21A and the side surface of the first vertical wiring line 51 being less than or equal to 77°. In this case, the angle θ can be adjusted by varying the above-mentioned extra plating, the degree of light convergence of the laser, and so on.

Note that the relationship between the first coil wiring line 21A and the second vertical wiring line 52 is also preferably identical to the relationship between the first coil wiring line 21A and the first vertical wiring line 51 and description thereof is omitted. In addition, the same configuration as the first coil wiring line 21A is also preferable for the second coil wiring line and description thereof is omitted.

The present disclosure is not limited to the above-described embodiments and design changes can be made within a range that does not deviate from the gist of the present disclosure. For example, the characteristic features of the first and second embodiments may be combined with each other in various ways. For example, the curvature of the top surface of a coil wiring line may substantially lie in a range from 1/8000 m to 1/6000 m and the angle formed between a tangent at an intersection between the top surface of the coil wiring line and the side surface of the first vertical wiring line, and the side surface of the first vertical wiring line may substantially lie in a range from 65° to 77°.

In the above-described embodiments, two coil wiring lines, namely, the first coil wiring line and the second coil wiring line, are arranged inside the element body, but one or three or more coil wiring lines may instead be arranged inside the element body.

In the above-described embodiments, the number of turns of each coil wiring line is less than one turn, but the number of turns of each coil wiring line may exceed one turn. In other words, there are no limits on the shapes of the coil wiring lines and a variety of known shapes can be used. In addition, the total number of coil wiring lines is not limited to one layer and there may be two or more layers in a multilayer configuration. In particular, the term "coil wiring line" used in the present specification refers to a coil wiring line that gives inductance to an inductor component by generating magnetic flux in a magnetic layer when a current flows and there are no particular restrictions on the structure, shape, material, and so forth of the coil wiring lines. Specifically, the coil wiring lines are not limited to forming a spiral curve extending along a plane as described in the embodiments and various known wiring line shapes such as meandering wiring lines can be used.

In the embodiments, the resin layer covers the first coil wiring line and the second coil wiring line in an integrated manner, but may instead cover the first coil wiring line and the second coil wiring line in a separate manner. Furthermore, the number of layers forming the element body is not particularly limited and the element body may have a single-layer structure consisting of only a magnetic layer or only an insulating layer or may have a multilayer structure.

In the embodiments, the vertical wiring lines each consist of a via conductor that penetrates through the resin layer and a columnar wiring line that penetrates through the magnetic layer but the vertical wiring lines may instead each consist of either one of the via conductor and the columnar wiring line. For example, in the case where the resin layer is not provided, the vertical wiring lines will penetrate through only the magnetic layer, and therefore the vertical wiring lines will each consist of only the columnar wiring line. On the other hand, in the case where the vertical wiring lines penetrate through only the resin layer, the vertical wiring lines will each consist of only the via conductor. Furthermore, although the shape of the columnar wiring lines is a substantially rectangular shape when looking in the Z direction, the shape may instead be a substantially circular, elliptical, or oval shape.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

an element body;

a coil wiring line that is arranged parallel to a first main surface of the element body inside the element body; and a first vertical wiring line and a second vertical wiring line that are buried inside the element body so that end surfaces thereof are exposed from the first main surface of the element body and that are electrically connected to the coil wiring line;

wherein in a first cross section that is perpendicular to a direction in which the coil wiring line extends and intersects the first vertical wiring line, a top surface of the coil wiring line contacts a bottom surface of the first vertical wiring line and the top surface of the coil wiring line is substantially shaped like a convex surface; and in the first cross section, a curvature of the top surface of the coil wiring line substantially lies in a range from $1/8000$ m to $1/6000$ m.

2. An inductor component comprising:

an element body;

a coil wiring line that is arranged parallel to a first main surface of the element body inside the element body; and a first vertical wiring line and a second vertical wiring line that are buried inside the element body so that end surfaces thereof are exposed from the first main surface of the element body and that are electrically connected to the coil wiring line;

wherein in a first cross section that is perpendicular to a direction in which the coil wiring line extends and intersects the first vertical wiring line, a top surface of the coil wiring line contacts a bottom surface of the first vertical wiring line and the top surface of the coil wiring line is substantially shaped like a convex surface; and in the first cross section, the top surface of the coil wiring line intersects a side surface of the first vertical wiring line, and an angle formed between a tangent, which is tangential to the top surface of the coil wiring line at an intersection between the top surface of the coil wiring line and the side surface of the first vertical wiring line, and the side surface of the first vertical wiring line substantially lies in a range from 65° to 77°.

3. The inductor component according to claim 1, wherein the element body includes a resin layer that covers the coil wiring line, and the first vertical wiring line and the second vertical wiring line each include a via conductor that penetrates through the resin layer and contacts the top surface of the coil wiring line.

4. The inductor component according to claim 3, wherein a bottom surface of the via conductor is shorter than the top surface of the via conductor in terms of length in a direction parallel to the first main surface in the first cross section.

5. The inductor component according to claim 1, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

6. The inductor component according to claim 1, wherein in the first cross section, the top surface of the coil wiring line intersects a side surface of the first vertical wiring line, and an angle formed between a tangent, which is tangential to the top surface of the coil wiring line at an intersection between the top surface of the coil wiring line and the side surface of the first vertical wiring line, and the side surface of the first vertical wiring line substantially lies in a range from 65° to 77°.

7. The inductor component according to claim 1, wherein the element body includes a resin layer that covers the coil wiring line, and the first vertical wiring line and the second vertical wiring line each include a via conductor that penetrates through the resin layer and contacts the top surface of the coil wiring line.

8. The inductor component according to claim 2, wherein the element body includes a resin layer that covers the coil wiring line, and the first vertical wiring line and the second vertical wiring line each include a via conductor that penetrates through the resin layer and contacts the top surface of the coil wiring line.

9. The inductor component according to claim 6, wherein the element body includes a resin layer that covers the coil wiring line, and the first vertical wiring line and the second vertical wiring line each include a via conductor that penetrates through the resin layer and contacts the top surface of the coil wiring line.

10. The inductor component according to claim 7, wherein a bottom surface of the via conductor is shorter than the top surface of the via conductor in terms of length in a direction parallel to the first main surface in the first cross section.

11. The inductor component according to claim 8, wherein a bottom surface of the via conductor is shorter than the top surface of the via conductor in terms of length in a direction parallel to the first main surface in the first cross section.

12. The inductor component according to claim 9, wherein a bottom surface of the via conductor is shorter than the top surface of the via conductor in terms of length in a direction parallel to the first main surface in the first cross section.

13. The inductor component according to claim 1, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

14. The inductor component according to claim 2, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

15. The inductor component according to claim 3, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

16. The inductor component according to claim 4, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

17. The inductor component according to claim 6, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

18. The inductor component according to claim 7, wherein in a second cross section that is perpendicular to a direction in which the coil wiring line extends and intersects the second vertical wiring line, a top surface of the coil wiring line contacts a bottom surface of the second vertical wiring line and the top surface of the coil wiring line is substantially shaped like a convex surface.

* * * * *